US005851318A

United States Patent [19]

Klöwer

[11] Patent Number: 5,851,318

[45] Date of Patent: Dec. 22, 1998

[54] HIGH TEMPERATURE FORGEABLE ALLOY

[75] Inventor: Jutta Klöwer, Iserlohn, Germany

[73] Assignee: Krupp VDM GmbH, Werdohl, Germany

[21] Appl. No.: 769,347

[22] Filed: Dec. 19, 1996

Related U.S. Application Data

[63] Continuation of Ser. No. 488,505, Jun. 9, 1995, abandoned.

[51] Int. Cl.[6] ..... C22C 30/00; C22C 19/05

[52] U.S. Cl. ..... 148/410; 148/419; 148/428; 148/442

[58] Field of Search ..... 420/443, 584.1, 420/446, 447; 148/410, 428, 419, 442

[56] References Cited

U.S. PATENT DOCUMENTS

| | | | |
|---|---|---|---|
| 124,858 | 6/1872 | Hessenbruch | 420/443 |
| 4,054,469 | 10/1977 | Jackson . | |
| 4,359,352 | 11/1982 | Ray et al. | 148/409 |
| 4,839,140 | 6/1989 | Cathcart et al. . | |

FOREIGN PATENT DOCUMENTS

| | | |
|---|---|---|
| 0 386 730 | 9/1990 | European Pat. Off. . |
| 0 531 775 | 3/1993 | European Pat. Off. . |
| 639652 | 7/1994 | European Pat. Off. . |
| 1512984 | 6/1978 | United Kingdom . |

OTHER PUBLICATIONS

JPO Abstract of 05–171,340, Jul. 1993.
JPO Abstract of 05–239,576, Sep. 1993.
JPO Abstract of 05–239,577, Sep. 1993.
JPO Abstract of 06–207,235, Jul. 1994.
JPO Abstract of 06–207,236, Jul. 1994.
JPO Abstract of 07–041,893, Feb. 1995.
M.R. Jackson, Conference of In Situr Compos., (Proc.), 2nd; "The nickel–chromium–aluminum–iron (.gamma.–beta.) eutectic system", pp. 67–75, 1976.

*Primary Examiner*—Margery Phipps
*Attorney, Agent, or Firm*—Proskauer Rose LLP

[57] ABSTRACT

The invention relates to a high temperature forgeable alloy consisting of

<0.05 C
<0.5 Si
<0.5 Mn
8.5 to 11 Al
<0.02 P
<0.01 S
4 to 10 Cr
23 to 28 Fe
0.025 to 0.2 Hf and/or rare earths and/or Zr
<0.5 Ti
<0.005 B residue nickel and admixtures due to melting. It is used in the production of articles for energy technologies and in the chemical industry. The alloy is resistant to sulphidization, carbonization and oxidation at temperatures between 400° and 1100° C.

3 Claims, 7 Drawing Sheets

HIGH TEMPERATURE FORGEABLE ALLOY

This is a continuation of application Ser. No.08/488,505, filed Jun. 9, 1995 now abandoned.

The invention relates to a high temperature forgeable alloy on a nickel basis which contains aluminium, chromium, iron and hafnium. Such a shapeable, heat-resistant nickel-based alloy, known from CA 1.166.484, has the composition 8 to 25% Cr, 2.5 to 8% Al and a small, but effective Y content, and also a total of up to 15% Hf and further elements and up to 30% Fe. Inter alia up to 20% Co and up to 5% Ti are also permitted. The alloy is also subjected to a suitable heat treatment to generate an aluminium oxide film prior to its intended use in firing kilns, more particularly as a support for the ceramic products to be fired, at possible temperatures of up to 1220° C. As a whole this prior art alloy is designed not to be affected by the high firing temperatures of the ceramic articles. However, due to the special marginal conditions, the alloy optimized for the aforementioned special use, is less suitable for wide long-term use in the construction of installations.

BACKGROUND OF THE INVENTION

With the upper limit of 25% chromium, the aforementioned alloy is still close to the high chromium-content alloys in which the protective effect by chromium oxides is of importance. Thus, for heat exchanger tubes in coal gasification plants tests are being carried out on alloys of the type X1NiCrMoCuN 31 27 4 (German Material No. 1.4563) and X1NiCrMoCu 32 28 7 (1.4562). However, if the protective effect of the chromium oxides is required, sufficient oxygen for oxide formation must be available in the process medium. Precisely in installations of the petrochemical industry and energy technology this is not the case, however, so that at present the permissible metal temperature of heat exchanger tubes and walls must be limited to approximately 450° C., to prevent any impermissible sulphurization of the material.

If process temperatures are to be raised, materials are required which can form a protective oxide layer even in low-oxygen atmospheres. Particularly advantageous in this case are high aluminium-content alloys, which can form dense stable $Al_2O_3$ layers even under extreme conditions. New nickel-based alloys having high aluminium contents, for example, 9 to 12% Al, 8 to 15% Cr, 9 to 16% Fe, 0.2 to 1.5% Zr, 0.2 to 1.5% Hf and 0.05 to 0.2% B (DE 3634635) are intended for use in turbine guide vanes in energy technology. However, as typical cast alloys they are brittle and cannot be prepared as semi-finished products in the form of sheet, tube or wire.

It is an object of the invention to further develop the known nickel-based alloys in respect to their resistance to carbonization and sulphurization in the temperature range of 400° to 1100° C., while maintaining their resistance to oxidation and also hot and cold shapeability.

DETAILED DESCRIPTION OF THE INVENTION

The invention therefore proposes a high temperature forgeable alloy of fine-grained duplex structure which contains (in % by weight)

<0.05 C
<0.5 Si
<0.5 Mn
8.5 to 11 Al

<0.02 p
<0.01 S
4 to 10 Cr
23 to 28 Fe 0.025 to 0.2 Hf and/or rare earths and/or Zr
<0.5 Ti
<0.005 B
residue nickel and admixtures due to melting.

Attention must be drawn to the advantageous narrowing-down of the analysis as set forth in the subclaim, namely a composition having:

<0.05 C
<0.5 Si
<0.5 Mn
9 to 11 Al
<0.02 P
<0.01 S
8 to 10 Cr
25 to 28 Fe
0.05 to 0.15 Hf and/or rare earths and/or Zr
<0.5 Ti
<0.005 B
residue nickel and admixtures due to melting.

The alloy according to the invention has a fine-grained duplex structure. One of the phases is a random cubically face-centred Ni, Fe, Al, Cr mixed crystal, the second phase being a cubically body-centred B2-ordered substoichiometric intermetallic phase.

The alloy according to the invention can be forged, rolled and welded and used in carbon-containing and sulphur-containing process gases even at temperatures above 750° C.

Table 1 shows by way of example a number of analyses of the alloy according to the invention (analyses A to F) and also alloys (G, H, I) of charges cited for purposes of comparison and lying outside the composition according to the invention. The right-hand column shows the high resistivity of the alloys A to F according to the invention in a corrosive atmosphere at 1100° C.

BRIEF DESCRIPTION OF THE DRAWINGS

FIG. 6 (*b*) is a photograph of the structure of Ni—26Fe—10Al—8Cr after cold rolling and annealing at 800° C. for 1 hour.

FIG. 6 (*c*) is a photograph of the structure of Ni—26Fe—10Al—8Cr after cold rolling and annealing at 1000° C. for 1 hour.

FIG. 6 (*d*) is a photograph of the structure of Ni—26Fe—10Al—8Cr after cold rolling and annealing at 1200° C. for 1 hour.

FIG. 1 shows an isothermal section through the ternary system Fe—Ni—Al at 850° C. to demonstrate the effect of the alloying elements nickel, iron and aluminium. Conventional high temperature forgeable alloys of type 1.4958 (X5NiCAlTi3120) lie in the single phase range (Ni). Two-phase (Ni)+α' alloys with aluminium contents above 5% are typical of the turbine vane precision cast alloys; however, these two-phase alloys are brittle and can be neither forged nor rolled. Single-phase alloys are hot brittle and liable to sulphidization.

Figure 1:
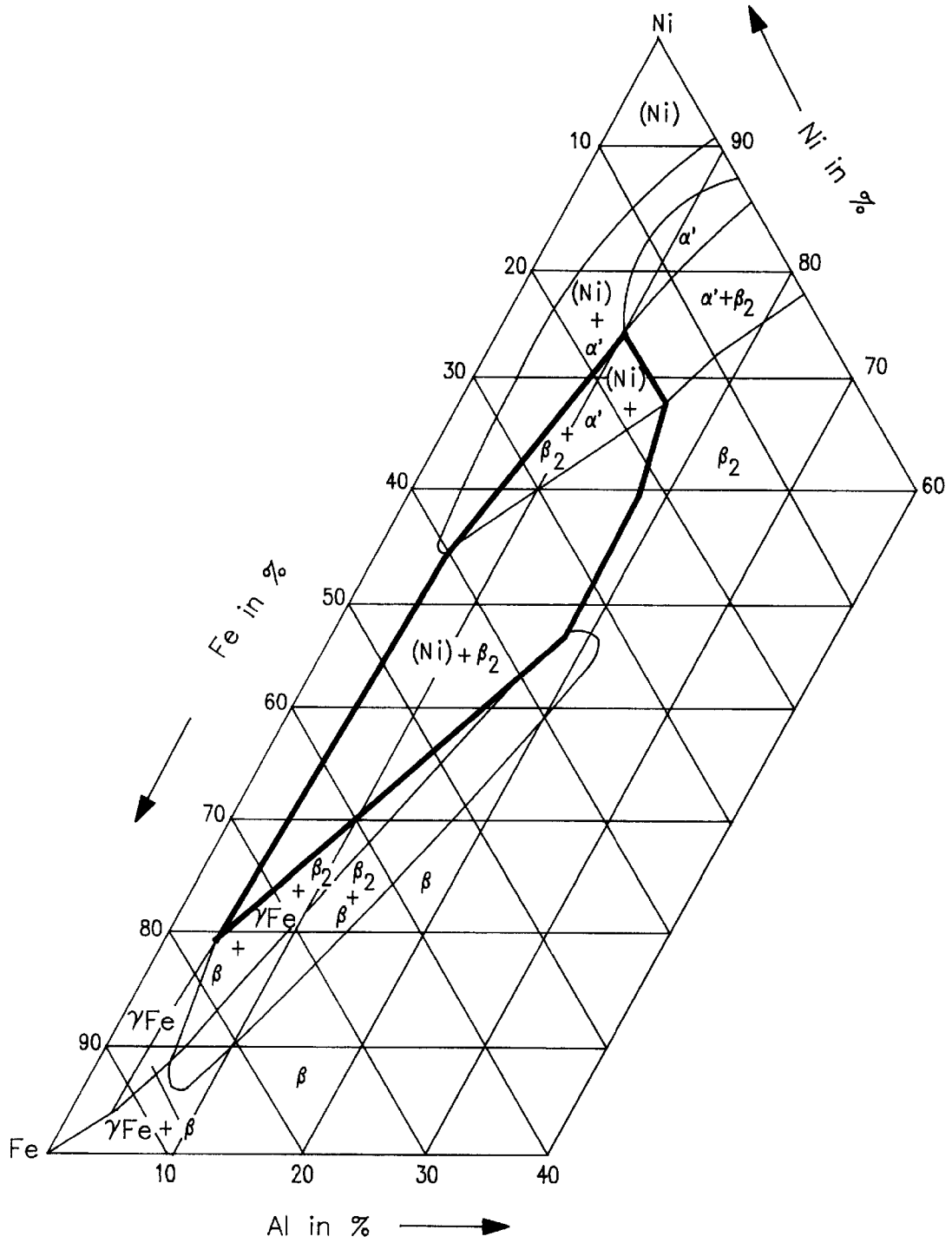
FIG. 1 shows an isothermal section through the ternary system Ni—Fe—Al at 850° C.

As can be gathered from FIG. 1, the alloy according to the invention has 10% aluminium and approximately 55 to 60% nickel close to the limit between the two-phase range (Ni)+$\beta_2$ and the three-phase range (Ni)+$\beta_2$+α'. The $\beta_2$ phase is a cubically body-centred, B2-ordered intermetallic Ni(Fe) Al compound; the phase (Ni) is a disordered cubically face-centred mixed crystal. The intermetallic L12-ordered α' phase can be present finely distributed as the third structure of the component in certain temperature ranges.

Figure 2:
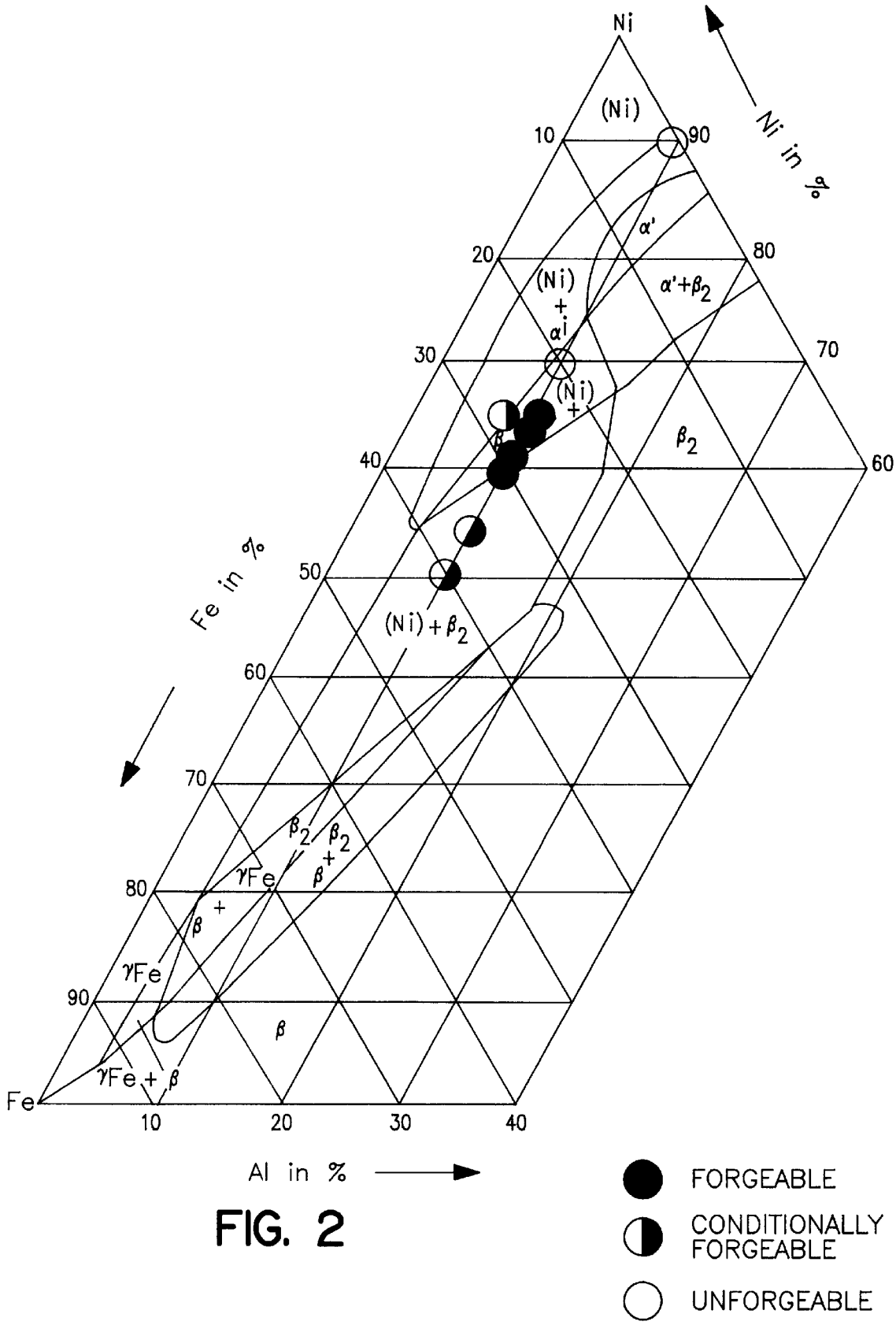
FIG. 2 is a plot of an isothermal section through the ternary system Ni—Fe—Al at 850° C., demonstrating the results of the forging tests on Ni—Fe—Al alloys.

Alloys of these phase ranges are also usually brittle and can be produced solely as cast alloys or by powder metallurgy. DE 1812144 discloses an example containing 2–20% aluminium, fairly high chromium-iron and tungsten contents and an extremely high content of the inherently impermissible, embrittling oxygen. However, it has now been surprisingly found that (Ni)+$\beta_2$ alloys and (Ni)+$\beta_2$+α' alloys are both cold and also hot shapeable on condition that the composition of the alloy is so adjusted that the proportions of (Ni) phase and $\beta_2$ phase are each approximately 50%. This is achieved with an aluminium content of 10%+1%. To ensure satisfactory shapeability, the iron/nickel ratio must be precisely adjusted. As FIG. 2 shows, the best forgeability and hot rollability is obtained if the iron content is approximately 26%. The exemplary alloys were plotted in the diagram on the basis that chromium occupies substantially one half of the lattice sites of the iron and one half of the lattice sites of the nickel. With iron contents below 20% a distinct decrease in shapeability can be detected; excessive iron contents reduce resistance to oxidation and also shapeability.

Figure 3:
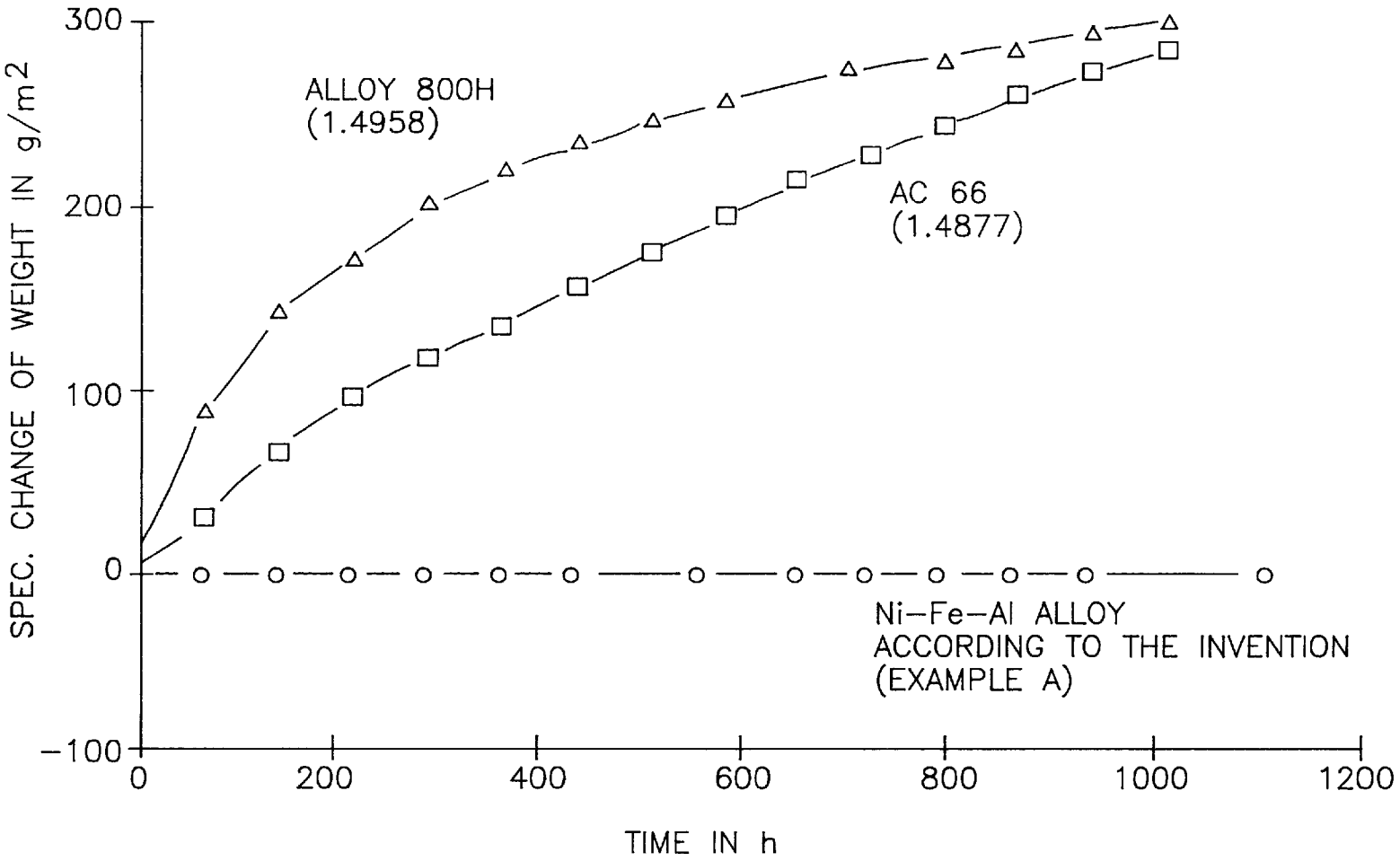
FIG. 3 is a plot of the carbon absorption as a function of time, where the materials are aged in methane/hydrogen gas.
Figure 4A:
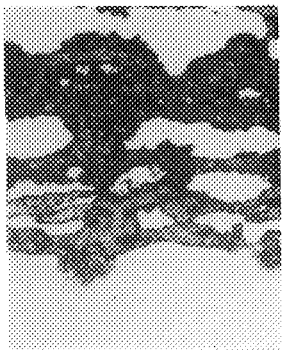
FIGS. 4 (*a*), 4 (*b*), 4 (*c*), and 4 (*d*) are photographs of the structure of Ni—Fe—Al—Cr alloys after 1000 hours in a coal gasification atmosphere at 600° C.
Figure 4B:
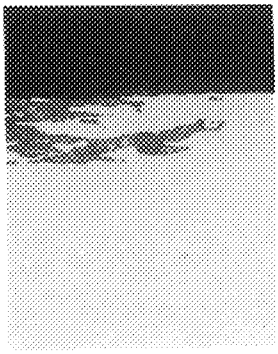
Figure 4C:
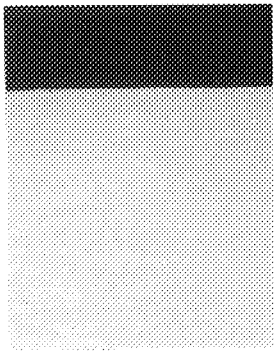
Figure 4D:
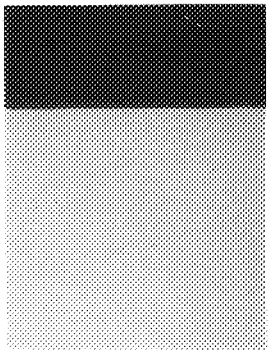

FIG. 3 shows the resistance to carbonization of the alloy according to the invention in comparison with that of Material 1.4958 and Material 1.4877. The satisfactory resistance to carbonization of the alloy according to the invention is the result of the high aluminium contents. An aluminium content of approximately 10% is of assistance in maintaining the protective aluminium oxide layers even over long periods of use. Table 2, which shows the results of tests carried out in an $H_2S$-containing sulphurizing coal gasification atmosphere at 750° C. indicates that the corrosive attack of the alloy according to the invention by sulphidization is marginal.

TABLE 2

Change of weight by sulphur absorption and metallographically determined corrosive attack after 2000 hours' ageing in a coal gasification atmosphere with 0.3% $H_2S$ at 750° C.

| Material | Internal corrosion in μm | Layer thickness in μm | Change of weight in g/m² | Corrosive attack in mm/year (extrapolated) |
|---|---|---|---|---|
| 1.4958 | 200 | 50 | 172 | 1.5 |
| 1.4877 | 150 | 120 | 64 | 1.7 |
| Alloy acc. to the inv., Example c | — | 12 | 16 | <0.1 |

The outstanding resistance to sulphidization in oxygen-containing and low-oxygen media is achieved by the combination of high chromium and high aluminium contents. As FIG. 4 shows, a minimum chromium content is required for a high resistance to sulphurization in $H_2S$-containing gases. However, if the chromium content is increased above 10%, a distinct decrease in shapeability is detected. For these reasons the chromium content is limited to 10%.

Figure 5:
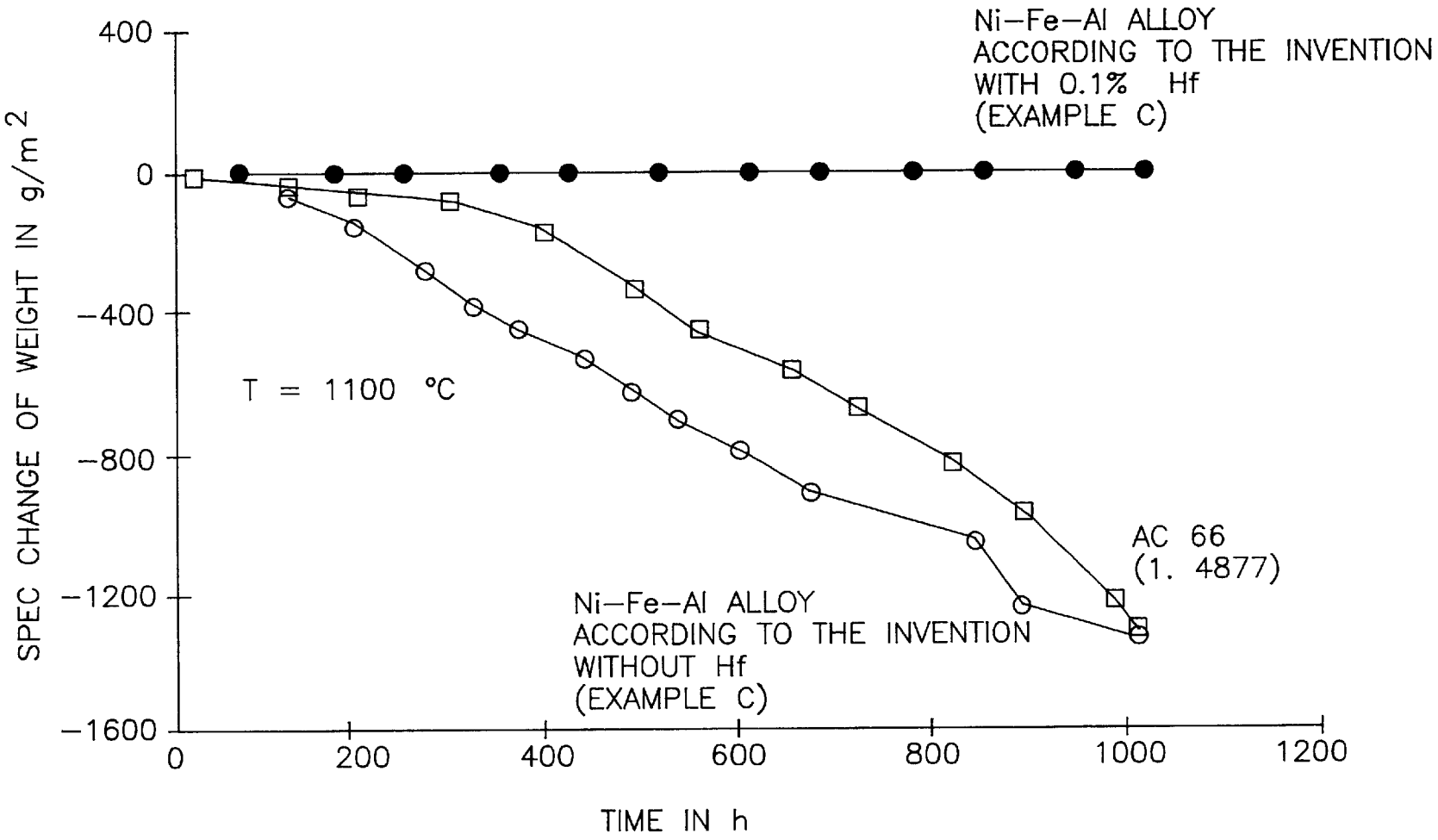
FIG. 5 compares the oxidation behavior of alloys.
Figure 6A:
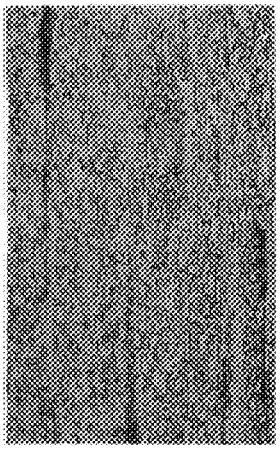
FIG. 6 (*a*) is a photograph of the structure of Ni—26Fe—10Al—8Cr after cold rolling.
Figure 6B:
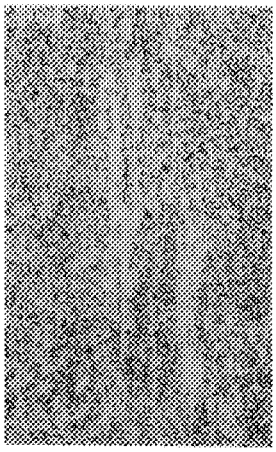
Figure 6C:
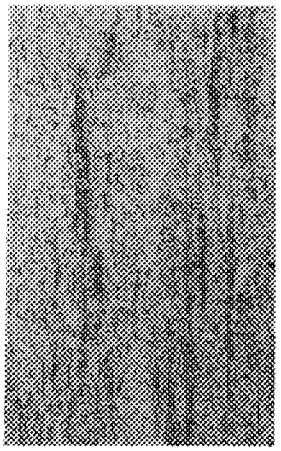
Figure 6D:
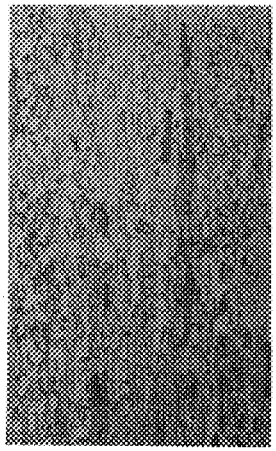

Since in technical processes constructional members are often exposed to atmospheric oxygen at high temperatures on the side remote from the medium involved in the process, the materials used in technical processes must usually also have a high resistance to oxidation. That means that the material must be stable against internal oxidation and also against the peeling of poorly adhering oxide layers. The satisfactory adhesion of the protective oxide layers is achieved by the addition of 0.1% hafnium to the alloy according to the invention. FIG. 5 shows the good resistance to oxidation of this alloy and the favourable effect of hafnium. This graph shows the change in weight at 1100° C. in air, measured in a cyclic oxidation test using a 24-hour cycle, as a function of ageing time. An increase in weight means an increase in oxygen, a decrease in weight showing that poorly adhering oxide layers are peeling. While the two alloys 1.4958 and 1.4877, just like the alloy according to the invention, show a distinct decrease in weight due to peeling without the addition of hafnium at 1100° C. in air, the hafnium-containing alloy according to the invention remains stable. However, the hafnium content must not exceed 0.2%, since in that case there is the danger of the formation of internal hafnium oxides, which would lead to an embrittlement of the material.

The high resistance to oxidation of this alloy makes it also very suitable for use as a heat-conducting material in industrial furnace construction and in other applications, for example, as an alternative to the high alloy ferritic iron-chromium-aluminium materials, which are difficult to process.

For the same reason the contents of silicon and titanium are limited to 0.5%. In a higher concentration these two elements may have an embrittling effect due to the formation of intermetallic phases. Manganese has an unfavourable effect on resistance to oxidation and for that reason is also limited to a maximum value of 0.5%.

The phosphorus and sulphur contents should be kept as low as possible, since these two elements may both reduce resistance to high temperature corrosion and also encourage intercrystalline brittle fracture by reducing grain boundary cohesion.

Oxygen has an embrittling effect and for that reason should be limited to a minimum. Carbon also has an embrittling effect and for that reason is limited to 0.05%.

Figure 7:
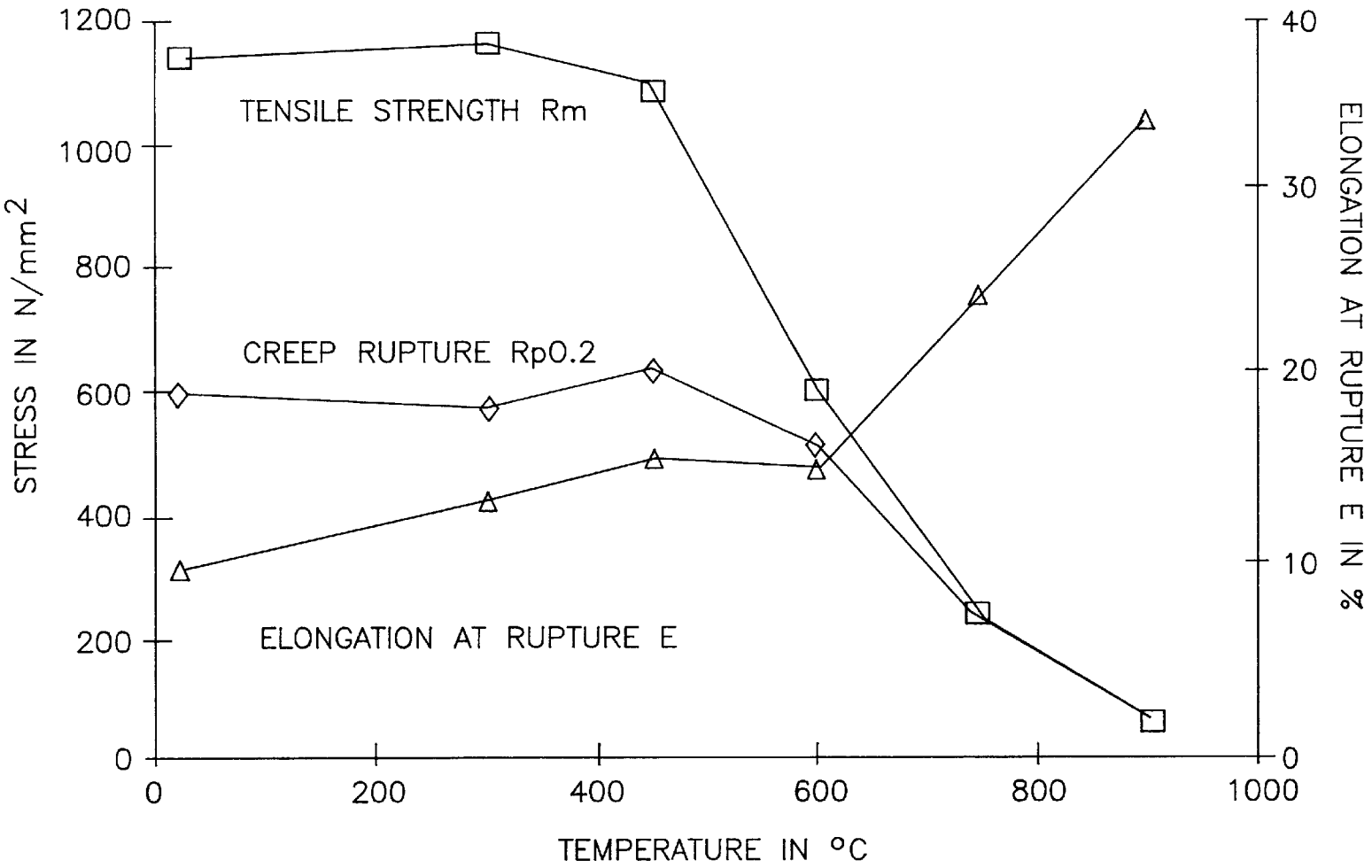
FIG. 7 shows the mechanical properties of Ni—26Fe—10Al—8Cr as a function of temperature.

The alloy according to the invention can be produced both by ingot casting and also by continuous casting after melting in a vacuum induction furnace or open melting. Hot shaping is performed by hot rolling or forging, cold shaping by rolling. Structure adjustment is performed by a recrystallization annealing at a temperature above 1000° C.; lower annealing temperatures do not ensure a complete recrystallization of the structure. After annealing a very fine-grained uniform duplex structure can be found as is shown in FIG. 6. The mechanical properties of this structure are shown in FIG. 7 exemplary. The tensile strength and the Rp0.2 creep limit are clearly above the values measured in the Material 1.4958 throughout the whole temperature range. At room temperature elongation at rupture reaches the values of highly heat-resistant ferritic steels; it increases with increasing temperature. At temperatures above 1150° C. the material can be very satisfactorily hot shaped. In dependence on the cooling conditions, a third phase may be present finely distributed in the structure. The mechanical properties can be varied over a wide range by a suitable selection of heat treatment temperatures and cooling speed.

The hafnium can be wholly or partially replaced by rare earths such as, for example, cerium, lanthanum, mixed metal or else yttrium. It is also possible to substitute zirconium for these elements.

The alloy according to the invention is outstandingly suitable for the production of articles which must be resistant to sulphidization, carbonization and oxidation at temperatures between 400° and 1100° C., namely for use at power stations and in the chemical and petrochemical industries.

Parts of installations, which can also be welded, used with the alloy according to the invention in the high temperature section of such technological energy or chemical installations are distinguished by high resistance to carbonization and sulphurization, since these parts of installations, such as pipes and boiler walls, are often exposed to atmospheric oxygen on the side remote from the gas involved in the process, their good resistance to oxidation also has its effect. The temperature strength required with regular temperatures between 400° and 1000° C. is achieved; at 1100° C. it is still adequate.

TABLE 1

Alloy examples

| Example | Chemical composition in % | | | | | | | | | | | Forgeable? | Change in weight after 1000 h at 1100° C. in g/m²* |
|---|---|---|---|---|---|---|---|---|---|---|---|---|---|
| | Ni | Fe | Al | Cr | Hf | C | Si | Ti | Mn | P | S | YES | |
| A | 55,8 | 26 | 10 | 8 | 0,11 | 0,005 | 0,03 | 0,01 | 0,03 | 0,003 | 0.002 | YES | +8,5 |
| B | "58,8 | 23 | 10 | 8 | 0,10 | 0,004 | 0,04 | 0,01 | 0,04 | 0,002 | 0,002 | YES | +4,15 |
| C | "54,9 | 26 | 10,8 | 8 | 0,12 | 0,007 | 0,03 | 0,01 | 0,04 | 0,004 | 0,002 | YES | +10,4 |
| D | "55 | 27 | 10,8 | 6 | 0,11 | 0,008 | 0,10 | 0,01 | 0,06 | 0,005 | 0,002 | YES | +10,9 |
| E | "57,6 | 25 | 9,1 | 8 | 0,13 | 0,009 | 0,07 | 0,01 | 0,04 | 0,002 | 0,002 | YES | +13,3 |
| F | "62,6 | 23 | 10,1 | 4 | 0,11 | 0,010 | 0,03 | 0,02 | 0,03 | 0,002 | 0,002 | YES | +12,9 |
| G | "62,8 | 20 | 9 | 8 | — | 0,007 | 0,11 | 0,02 | 0,02 | 0,002 | 0,002 | N0 | −950 |
| H | "48,7 | 24 | 8 | 19 | 0,11 | 0,006 | 0,09 | 0,01 | 0,04 | 0,004 | 0,002 | CONDITIONAL | −15,9 |
| I | "56,9 | 25 | 10 | 8 | — | 0,005 | 0,03 | 0,01 | 0,03 | 0,003 | 0,002 | CONDITIONAL | −6 |
| 1.4877 | 33 | Rest | — | 27 | — | 0,025 | <0,3 | 0,06 | — | 0,02 | 0,002 | YES | −1180 |

*Negative figures mean that corrosion products are already peeling

I claim:

1. A high temperature forgeable alloy of fine-grained duplex consisting (in % by weight)

<0.05 C

<0.5 Si

<0.5 Mn 8.5 to 11 Al

<0.02 p

<0.01 S 4 to 10 Cr 23 to 28 Fe 0.025 to 0.2 Hf

<0.5 Ti

<0.005 B residue nickel and admixtures due to melting.

2. A high temperature forgeable alloy according to claim 1, consisting (in % by weight) of

<0.05 C

<0.5 Si

<0.5 Mn 9 to 11 Al

<0.02 p

<0.01 S 8 to 10 Cr 25 to 28 Fe 0.05 to 0.15 Hf

<0.5 Ti

<0.005 B residue nickel and admixtures due to melting.

3. An article of manufacture made from the alloy of claim 1, said alloy being resistant to sulphidization, carbonization, and oxidation at temperatures between 400° and 1100° C.

* * * * *